US005249553A

United States Patent [19]

Guiod

[11] Patent Number: 5,249,553

[45] Date of Patent: Oct. 5, 1993

[54] ROTARY VALVE SHAFT INDENT SYSTEM

[76] Inventor: James J. Guiod, 46 Main St., Dover, Mass. 02030

[21] Appl. No.: 693,390

[22] Filed: Apr. 30, 1991

[51] Int. Cl.[5] ..... F01L 7/00

[52] U.S. Cl. ..... 123/41.4; 123/190.002

[58] Field of Search ..... 23/190 R, 190 A, 190 AA, 23/190 B, 190 BB, 190 BD, 41.4

[56] References Cited

U.S. PATENT DOCUMENTS

| | | | |
|---|---|---|---|
| 1,073,671 | 9/1913 | Fornaca | 123/190 B |
| 1,119,494 | 12/1914 | Bournouville | 123/190 B |
| 1,967,734 | 7/1934 | Baker | 123/190 A |
| 2,082,231 | 6/1937 | Strickland | 123/190.2 |
| 2,156,749 | 5/1939 | Baker | 123/190 BB |
| 3,526,215 | 9/1970 | Aspin | 123/190 D |
| 3,526,216 | 9/1970 | Henvaux | 123/190 BB |
| 3,892,220 | 7/1975 | Franz | 123/190 BB |
| 3,945,364 | 3/1976 | Cook | 123/190 D |
| 3,948,227 | 4/1976 | Guenther | 123/190 A |
| 3,989,025 | 11/1976 | Franco | 123/190 B |
| 4,077,382 | 3/1978 | Gentile | 123/190 A |
| 4,198,946 | 4/1980 | Rassey | 123/190 A |
| 4,381,737 | 5/1983 | Turner | 123/190 A |
| 4,473,041 | 9/1984 | Lyons et al. | 123/190 A |
| 4,556,023 | 12/1985 | Giocastro | 123/190 A |
| 4,562,796 | 11/1986 | Eickmann | 123/190 A |
| 4,776,306 | 10/1988 | Matsuura et al. | 123/190 A |
| 4,879,979 | 11/1989 | Triguero | 123/190 BB |
| 4,944,261 | 7/1990 | Coates | 123/190 A |
| 4,953,527 | 9/1990 | Coates | 123/190 B |

FOREIGN PATENT DOCUMENTS

| | | | |
|---|---|---|---|
| 127224 | 3/1932 | Austria | 123/190 B |
| 40645 | 8/1929 | Denmark | 123/190.2 |
| 0665715 | 9/1929 | France | 123/190.2 |
| 0079017 | 5/1984 | Japan | 123/190.2 |
| 0142006 | 7/1985 | Japan | 123/190.2 |
| 0058246 | 8/1937 | Norway | 123/190.2 |
| 2223800 | 4/1990 | United Kingdom | 123/190 R |

*Primary Examiner*—E. Rollins Cross
*Assistant Examiner*—Erick Solis

[57] ABSTRACT

A rotary valve shaft indent system for use in internal combustion engines including an intake manifold, and exhaust manifold, at least one combustion chamber having a piston and an ignition point, a cylinder head, an intake shaft rotatably mounted within the cylinder head and having at least one intake indent disposed thereon, and an exhaust shaft rotatably mounted within the cylinder head and having at least one exhaust indent disposed thereon. Upon rotation of the intake and exhaust shafts, the intake indent allows for intermittent connection of the intake manifold and the combustion chamber, and the exhaust indent allows for intermittent connection of the combustion chamber and the exhaust manifold.

16 Claims, 4 Drawing Sheets

ROTARY VALVE SHAFT INDENT SYSTEM

BACKGROUND OF THE INVENTION

Internal combustion engines are commonly used in vehicles and industrial machinery. These engines include an intake manifold, an exhaust manifold, at least one cylinder defining a combustion chamber having a piston and a spark plug, and a valve system for delivering the proper air/fuel mixture to the combustion chamber from the intake manifold and removing exhaust gases from the combustion chamber to the exhaust manifold after combustion.

Several rotary valve system designs for internal combustion engines have developed over the years to reduce engine inefficiencies associated with conventional valve systems and to increase engine power output. For example, U.S Pat. No. 4,879,979 teaches a valve system including a rotatable valve shaft having intake and exhaust slots formed through the shaft for intermittently connecting the intake manifold to the combustion chamber and the combustion chamber to the exhaust manifold. This design includes a complicated cooling system which requires a liquid coolant to flow through the center of the shaft. U.S. Pat. No. 4,944,261 and U.S. Pat. No 4,953,527 describe rotary valve systems having individual rotatable valve chambers for delivering fuel to and removing exhaust from the combustion chamber. These designs, however, require complicated manufacture which substantially increases total engine cost.

SUMMARY OF THE INVENTION

The rotary valve shaft indent system of the invention includes an intake manifold, an exhaust manifold, at least one combustion chamber having a piston and a spark plug, a cylinder head, an intake shaft having at least one intake indent disposed thereon, an exhaust shaft having at least one exhaust indent disposed thereon, and means for lubricating and cooling the intake and exhaust shafts.

The intake and exhaust shafts are rotatably mounted within the cylinder head between the combustion chamber and the intake and exhaust manifolds by at least one bearing positioned at each shaft end. Upon rotation of the intake shaft, the intake indent allows for intermittent connection of the intake manifold to the combustion chamber, and the unrestricted and direct flow of the air/fuel mixture into the combustion chamber. In addition, the intake indent is designed to assist the rotating intake shaft in forcing the air/fuel mixture in to the combustion chamber. When the exhaust shaft rotates, the exhaust indent allows for intermittent connection of the combustion chamber to the exhaust manifold, and the unrestricted and direct flow of exhaust from the combustion chamber. The exhaust indent is also designed to assist the rotating exhaust shaft in forcing the exhaust into the exhaust manifold.

When the air/fuel mixture enters the the combustion chamber via the intake indent and rotation of the intake shaft, the exhaust shaft is rotated so as to close the connection of the combustion chamber to the exhaust manifold. During combustion, the intake and exhaust shafts are rotated so as to close the connections of the intake and exhaust manifolds to the combustion chamber. When exhaust exits the combustion chamber via the exhaust indent and rotation of the exhaust shaft, the intake shaft is rotated so as to close the connection of the intake manifold to the combustion chamber.

The intake and exhaust indents can also be disposed on a single rotatable valve shaft. Operation of the single valve shaft is similar to the operation of the intake and exhaust shafts in that the intake and exhaust indents on the single valve shaft allow for intermittent connection of the intake and exhaust manifolds to the combustion chamber, and unrestricted and direct fluid flow into and out of the combustion chamber. In addition, the intake and exhaust indents are designed to assist the rotating valve shaft in forcing the air/fuel mixture into the combustion chamber and forcing the exhaust into the exhaust manifold.

The rotary valve shaft indent system of the invention is adaptable to any internal combustion engine. Because this system requires minimal torque input for shaft rotation and eliminates flow restrictions encountered by the air/fuel mixture and exhaust gases, increased engine power output is achieved. Furthermore, this system provides for direct and unobstructed access to the intake and exhaust manifolds with minimum fluid flow travel into and out of the combustion chamber, and therefore, reduces engine backpressure generated during engine operation. The valve system of this invention also reduces the cost of engine manufacture and overall cylinder head size because it eliminates several engine elements such as conventional valves, springs, guides, valve camshafts and rocker arms.

DESCRIPTION OF THE PREFERRED EMBODIMENT

Figure 1:
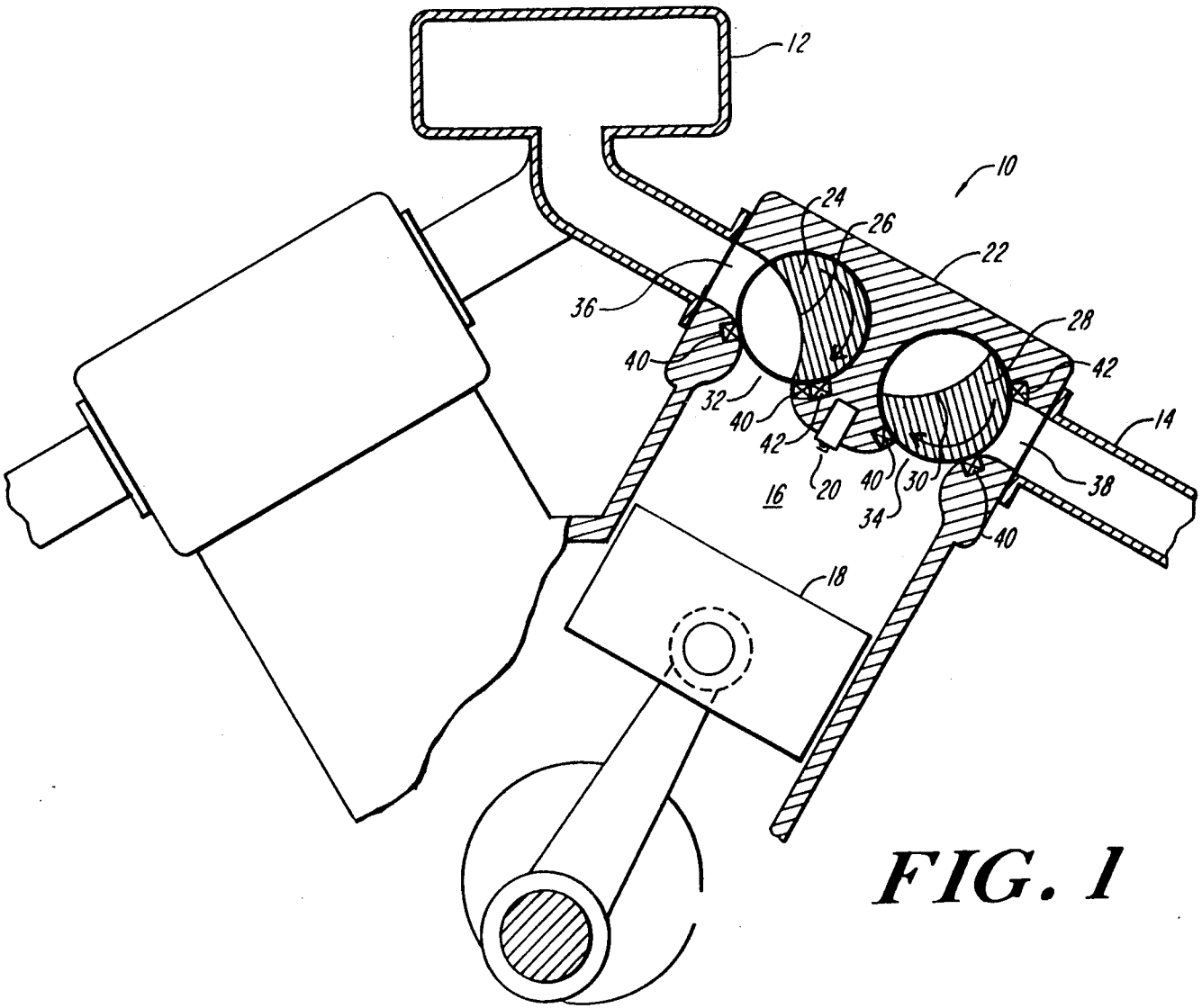
FIG. 1 is a front view of one embodiment of the rotary valve shaft indent system of the invention having an intake shaft and an exhaust shaft.

Referring to FIG. 1, the rotary valve shaft indent system 10 of the invention includes an intake manifold 12, exhaust manifold 14, at least one combustion chamber 16 having a piston 18 and an ignition point shown as a spark plug 20, a cylinder head 22, an intake shaft 24 having at least one intake indent 26 disposed thereon, and an exhaust shaft 28 having at least one exhaust indent 30 disposed thereon. The intake and the exhaust shafts 24 and 28 are rotatably mounted within the cylinder head 22 between the intake and exhaust manifolds 12 and 14 by bearings 46 located at each shaft end as shown in FIG. 3. Bearings 46 also absorb the combustion pressures exerted on the shafts 24 and 28 during engine operation.

Figure 7:
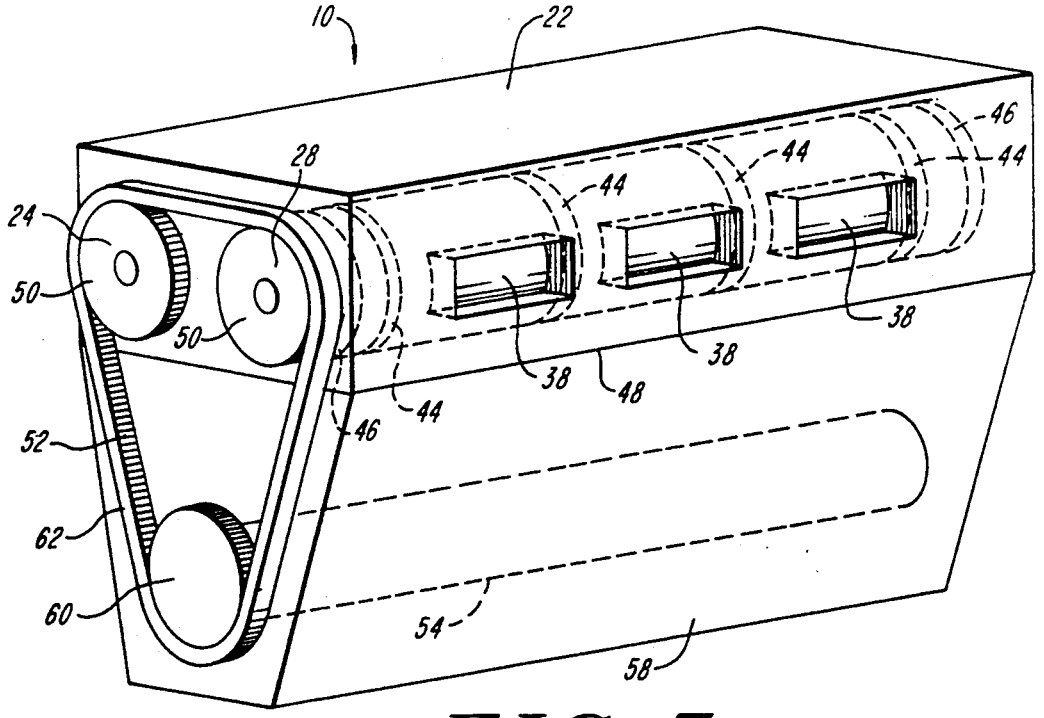
FIG. 7 is a perspective view of the rotary valve shaft indent system of FIG. 1 showing the crankshaft belt driven system.

As shown in FIG. 7, the intake and exhaust shafts 24 and 28 are driven by a belt 52 and a crankshaft 54 of a conventional crankshaft belt driven system 58. More specifically, the crankshaft includes a sprocket gear 60 and the intake and exhaust shafts 24 and 28 include a gear 50 positioned at one end of each shaft. The sprocket gear 60 and the shaft gears 50 engage belt 52 having teeth 62 for insuring accurate timing of the intake and exhaust shafts 24 and 28. The torque required to rotate the intake and exhaust shafts 24 and 28 is minimal due to the small frictional forces of the shaft bearing 46 surfaces, the compression and oil seals 40 and 42, and the air/fuel mixture and exhaust pressures. An articulated or timing advance system (not shown) could also be incorporated into the geared ends of the intake and exhaust shafts 24 and 28 to provide for variable shaft speed which would alter the time of intermittent connection of the intake and exhaust manifolds 12 and 14 to the combustion chamber 16. As engine speed increases, the timing advance system would alter the timing so as to provide improved fluid flows into and out of the combustion chamber 16.

When the intake shaft 24 rotates, as shown in FIG. 1, the intake indent 26 intermittently connects the intake manifold 12 at its exit port 36 to the combustion chamber 16 at its intake port 32 to allow for an air/fuel mixture to flow directly into the combustion chamber 16. The exhaust indent 30 of exhaust shaft 28 intermittently connects the exhaust port 34 of the combustion chamber 16 to the inlet port 38 of the exhaust manifold 14 upon rotation of the exhaust shaft 28 to allow exhaust to flow directly out of the combustion chamber 16.

Rotation of shafts 24 and 28 is slower than the rotation of shaft 54 of the crankshaft belt driven system 58. For example, the intake and exhaust indents 26 and 30 could be formed on their respective shafts 24 and 28 so that the shafts rotate one quarter of a revolution for every one revolution of crankshaft 54. Of course, the proper ratio of intake and exhaust shaft rotation to crankshaft rotation is dependent upon several engine parameters such as the number of engine cylinders, and the number and size of the intake and exhaust indents 26 and 30, and the timing and configuration of the crankshaft 54 of the crankshaft belt driven system 58.

When the air/fuel mixture flows from the intake manifold 12 to the combustion chamber 16 through the intake indent 26, the exhaust shaft 28 is rotated so as to seal off the combustion chamber 16 from the exhaust manifold 14. Further rotation of the intake shaft 24 forces the air/fuel mixture into the combustion chamber 16. Combustion of the air/fuel mixture occurs when the intake shaft 24 and the exhaust shaft 28 rotate so as to seal off the combustion chamber 16 from the intake manifold 12 and the exhaust manifold 14. While the intake shaft 24 continues to seal off the intake manifold 12 from the combustion chamber 16, exhaust gases exit the combustion chamber 16 when the exhaust shaft 28 rotates so as to allow the flow of exhaust from the combustion chamber 16 through the exhaust indent 30 to the exhaust manifold 14. Further rotation of the exhaust shaft 28 forces the the exhaust into the exhaust manifold 14.

Figure 2:
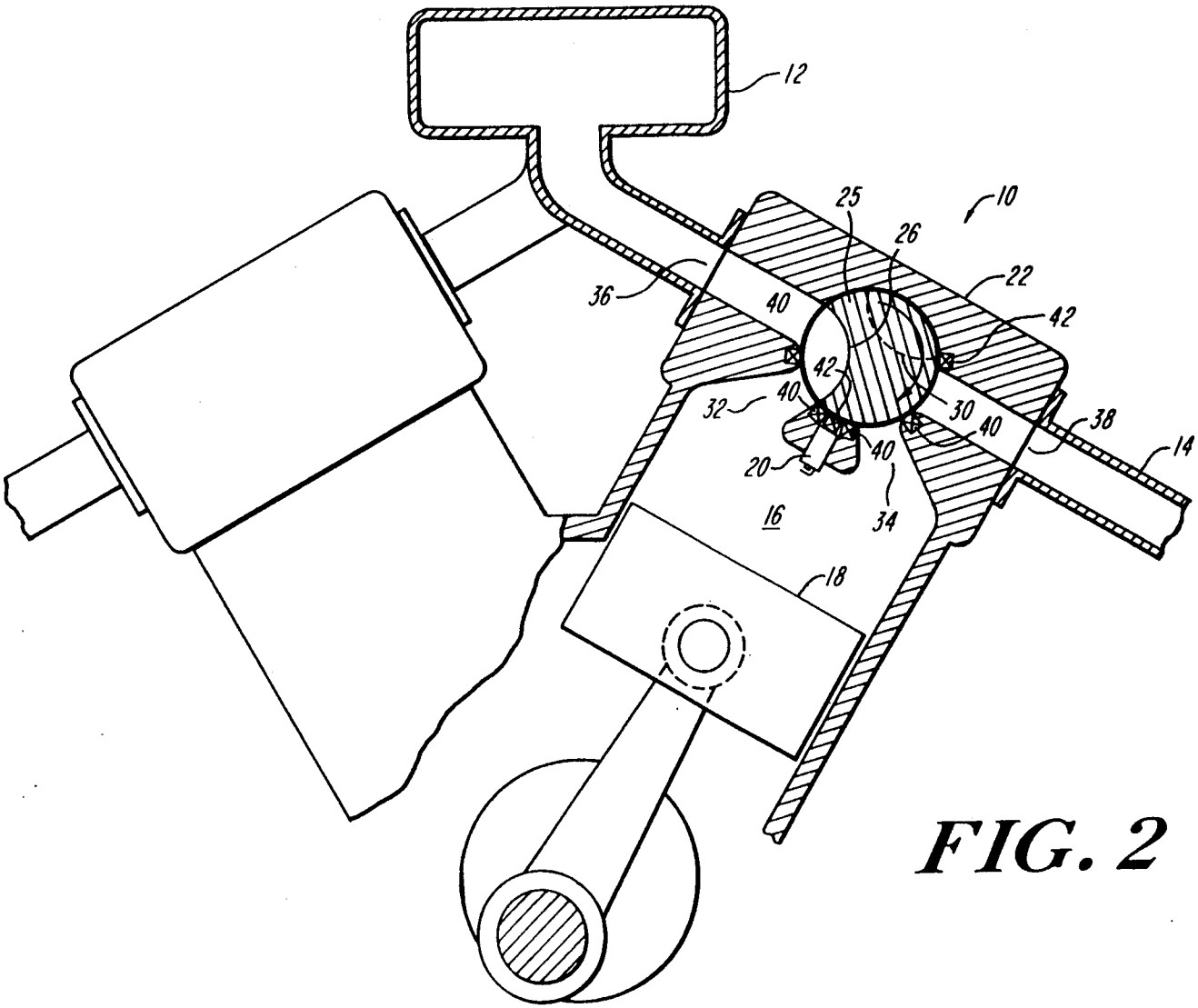
FIG. 2 is a front view of another embodiment of the rotary valve shaft indent system of the invention having one valve shaft.
Figure 6:
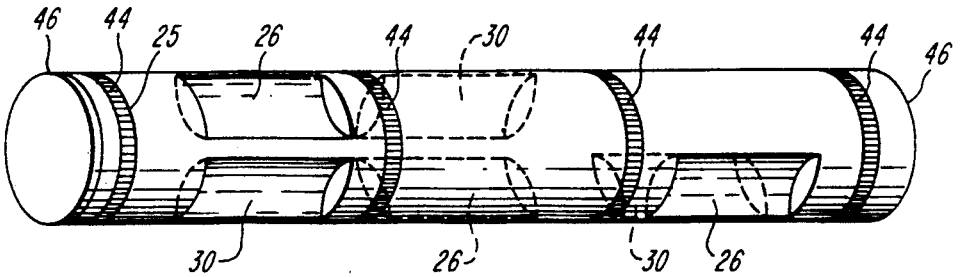
FIG. 6 is a perspective view of a valve shaft having a plurality of generally rectangular shaped intake and exhaust indents.

FIG. 2 shows another embodiment of the rotary valve shaft indent system 10 of the invention having one valve shaft 25 rotatably mounted within the cylinder head 22 between the intake manifold 12 and the exhaust manifold 14 by bearings 46 located at each shaft end as shown in FIG. 6. The valve shaft 25 includes at least one intake indent 26 and at least one exhaust indent 30, shown in FIG. 6 as generally rectangular shaped indents having a concave side, disposed on the valve shaft 25 so that when the intake indent 26 connects the intake manifold 12 to the combustion chamber 16 to allow for the unrestricted and direct flow of the air/fuel mixture, the valve shaft 25 seals off the combustion chamber 16 from the exhaust manifold 14. During combustion, the valve shaft 25 is rotated so as to seal off the combustion chamber 16 from the intake manifold 12 and the exhaust manifold 14. Exhaust gases exit the combustion chamber 16 when the valve shaft 25 rotates so as to seal off the combustion chamber 16 from the intake manifold 12 and the exhaust indent 30 is positioned so as to allow for the unrestricted and direct flow of exhaust gases from the combustion chamber 16 to the exhaust manifold 14. The rotation of the valve shaft 25 also forces the air/fuel mixture into the combustion chamber 16 and exhaust into the exhaust manifold 14.

As shown in FIG. 6, the intake and exhaust indents 26 and 30 are disposed on one half of the valve shaft 25. In this configuration, the valve shaft 25 will rotate one half of a revolution for every revolution of the crankshaft 54 of the crankshaft belt driven system 58. Of course, the proper ratio of valve shaft rotation to crankshaft rotation is dependent upon several engine parameters such as the number of engine cylinders, the number and size of the intake and exhaust indents 26 and 30, and the timing and configuration of the crankshaft 54 of the crankshaft belt driven system 58.

The intake indent 26 and the exhaust indent 30 are designed so as to provide unrestricted and direct fluid flow into and out of the combustion chamber, and to assist the rotating intake shaft 24 in forcing the air/fuel mixture into the combustion chamber 16 and assist the rotating exhaust shaft 28 in forcing the exhaust into the exhaust manifold 14. More specifically, the outer edge of the intake indent 26 must correspond and conform to the outer edge of the exit port 36 of the intake manifold 12 and the outer edge of the intake port 32 of the combustion chamber 16 so as to provide an unobstructed and continuous air/fuel mixture passageway. The entering air/fuel mixture engages an intake indent 26 surface and pushes the intake shaft 24 in its direction of rotation thereby assisting the rotating intake shaft 24 in forcing the air/fuel mixture into the combustion chamber 16.

The outer edge of the exhaust indent 30 must correspond to the outer edge of the exhaust port 34 of the combustion chamber 16 and the outer edge of the inlet port 38 of the exhaust manifold 14 so as to provide an unobstructed and continuous exhaust passageway. The exhaust engages an exhaust indent 30 surface and pushes the exhaust shaft 28 in its direction of rotation thereby assisting the exhaust shaft 28 in forcing the exhaust into the exhaust manifold 14. The design of the exhaust intent 30 also allows for exhaust expansion upon exit from the combustion chamber 16 and entry into the exhaust manifold 14.

Figure 3A:
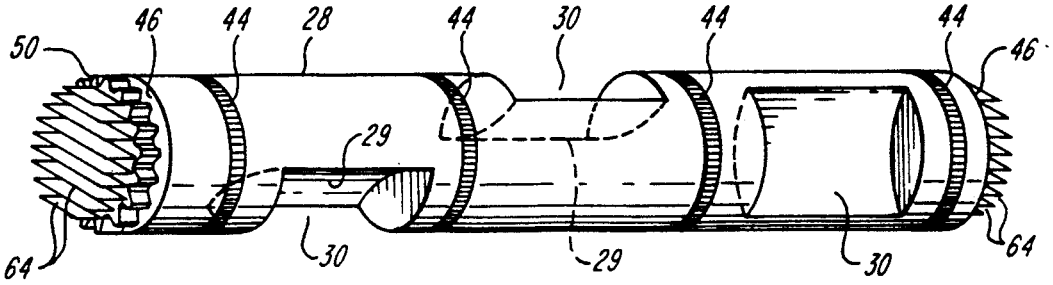
FIG. 3A is a perspective view of an exhaust shaft having a plurality of generally rectangular shaped exhaust indents.
Figure 4:
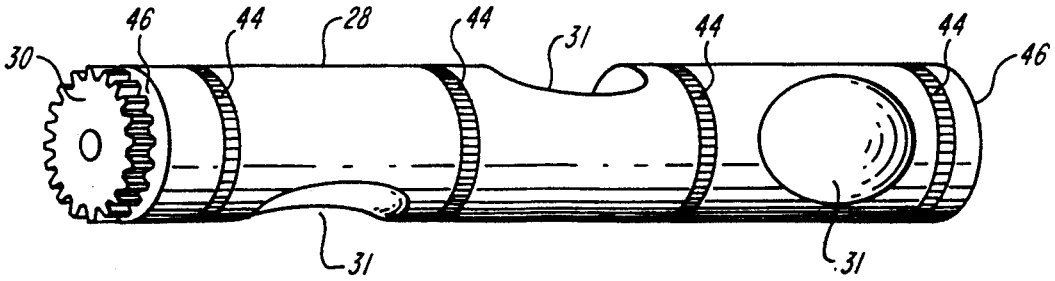
FIG. 4 is a perspective view of an exhaust shaft having a plurality of concave shaped exhaust indents.
Figure 5:
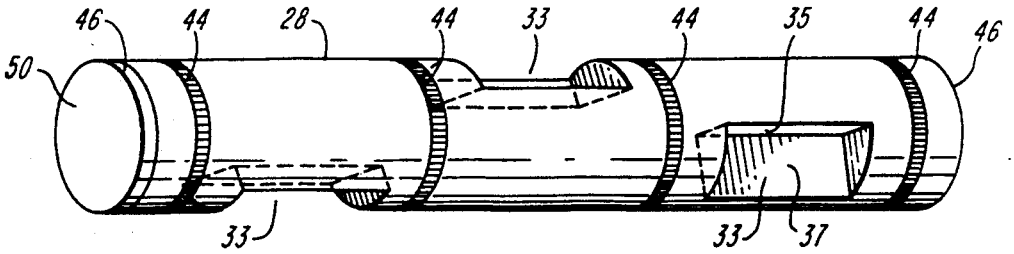
FIG. 5 is a perspective view of an exhaust shaft having a plurality of wedge shaped exhaust indents.

Various indent shapes will meet the aforementioned requirements depending on the configuration of the exit port 36 of the intake manifold 12, the inlet port 38 of the exhaust manifold 14, and the intake and exhaust ports 32 and 34 of the combustion chamber 16. As shown in FIG. 3A, the exhaust shaft 28 may include generally rectangular shaped exhaust indents 30 having at least one concave side 29 for facilitating continuous fluid flow. FIG. 4 shows an exhaust shaft 28 having concave shaped exhaust indents 31. FIG. 5 shows an exhaust shaft 28 having wedge shaped exhaust indents 33 having sides 35 and 37 of unequal length. The intake indents 26 of intake shaft 24 and the indents 26 and 30 on the valve shaft 25 may also be shaped as shown in FIGS. 3A, 4, and 5.

The intake and exhaust shafts 24 and 28 may be solid or hollow shafts made of any suitable material such as steel or aluminum. If solid shafts are used, the intake and exhaust indents 26 and 30 are machined directly into the shafts. If hollow shafts are used, shaft holes may be formed into the shafts for receiving indent elements of a desired shape rigidly secured within the shaft holes by a method such as welding. These indent elements form the intake and exhaust indents 26 and 30 disposed on the intake and exhaust shafts 24 and 28. The intake and exhaust shafts 24 and 28 of FIG. 1 and the valve shaft 25 of FIG. 2 also can act as balancing shafts or shaft to reduce engine operating vibrations, and therefore, eliminate the need for a conventional engine balancing shaft.

Figure 3B:
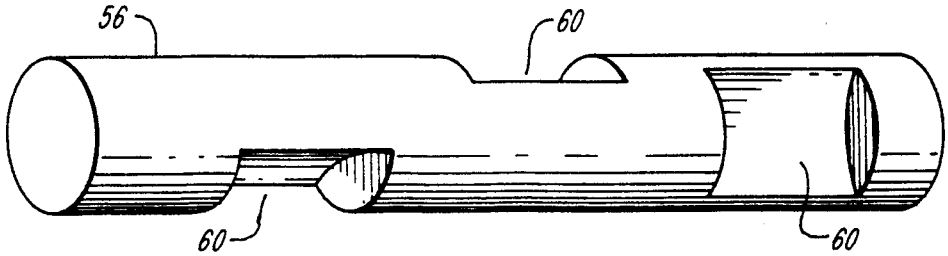
FIG. 3B is a perspective view of an exhaust shaft sleeve for the exhaust shaft of FIG. 3A.

The intake and exhaust shafts 24 and 28 of FIG. 1 and the valve shaft 25 of FIG. 2 may be securely disposed within a corresponding shaft sleeve to increase the operating life of the shaft. As shown in FIG. 3B, the shaft sleeve 56 for the exhaust shaft 28 includes shaft holes 60 corresponding to the exhaust indents 30 of FIG. 3A. Likewise, similar shaft sleeves can be securely disposed about the exhaust shafts shown in FIGS. 4 and 5, the valve shaft 25 of FIG. 6, and intake shafts having various intake indent shapes. If shaft sleeves are used, the shaft bearings 46 normally positioned at each shaft end must be disposed about each end of the shaft sleeve. Shaft sleeves should be made from a strength material such as steel.

The intake and exhaust shafts 24 and 28 include lubrication channels 44 disposed about the circumference of the shafts, as shown in FIGS. 3A, 4, 5 and 7, which deliver oil to the shafts via line 48 from an oil source (not shown). The intake port 32 of the combustion chamber 16 and the inlet port 38 of the exhaust manifold 14 include at least one oil seal 42 to prevent oil from the lubrication channels 44 from leaking into the intake manifold 12, the combustion chamber 16 and the exhaust manifold 14. Compression seals 40 to absorb engine operating pressures are disposed within the cylinder head 12 proximate to the intake and exhaust ports 32 and 34 of the combustion chamber 16. It is noted that additional oil and compression seals 42 and 40 may be incorporated into the rotary valve shaft indent system of the invention.

The intake shaft 24 may be cooled by the incoming air/fuel mixture and the exhaust shaft 28 may be cooled by ambient air. Alternatively, if hollow shafts are used, fins 64 may be mounted at each shaft end, as shown in FIG. 3A, to draw ambient air into the shafts for cooling.

What is claimed is:

1. A rotary valve shaft indent system for use in internal combustion engines comprising an intake manifold;

an exhaust manifold;

at least one combustion chamber having a piston and an ignition point;

a cylinder head;

a hollow intake shaft having at least one intake indent element disposed thereon;

a hollow exhaust shaft having at least one exhaust indent element disposed thereon;

means for lubricating the intake and exhaust shafts; and cooling fins disposed at least at one end of each shaft, said fins extending outwardly along the shaft's longitudinal axis for cooling the intake and exhaust shafts by drawing ambient air through the center of the hollow shafts;

wherein the intake and exhaust shafts are rotatably mounted within the cylinder head between the combustion chamber and the intake and exhaust manifolds by at least one bearing positioned at each end of the intake and exhaust shafts;

whereby upon rotation of the intake shaft, the intake indent element allows for intermittent connection of the intake manifold to the combustion chamber, and the unrestricted flow of an air/fuel mixture into the combustion chamber; and upon rotation of the exhaust shaft, the exhaust indent element allows for intermittent connection of the combustion chamber to the exhaust manifold, and the unrestricted and direct flow of exhaust from the combustion chamber.

2. The valve system of claim 1 wherein the exhaust shaft and the intake shaft are rotated so that when the intake indent element connects the intake manifold to the combustion chamber, the exhaust shaft is rotated so as to prevent the connection of the combustion chamber to the exhaust manifold; when combustion occurs in the combustion chamber, the intake shaft is rotated so as to prevent the connection of the intake manifold to the combustion chamber, and the exhaust shaft is rotated so as to prevent the connection of the combustion chamber to the exhaust manifold; and when the exhaust indent element connects the combustion chamber to the exhaust manifold, the intake shaft is rotated so as to prevent the connection of the intake manifold to the combustion chamber.

3. The valve system of claim 1 wherein the intake shaft is securely disposed within an intake shaft sleeve having at least one intake hole formed therein to correspond to the intake indent element of the intake shaft; and the exhaust shaft is securely disposed within an exhaust shaft sleeve having at least one exhaust hole formed therein to correspond to the exhaust indent of the exhaust shaft.

4. The valve system of claim 1 wherein the combustion chamber includes an intake port and an exhaust port;

the intake manifold includes an exit port; and the exhaust manifold includes an inlet port;

whereby the intake indent element is formed so as to provide an unobstructed and continuous passageway between the combustion chamber intake port and the intake manifold exit port, and to assist the rotating intake shaft in forcing an air/fuel mixture into the combustion chamber; and the exhaust indent element is formed so as to provide an unobstructed and continuous passageway between the combustion chamber exhaust port and the exhaust manifold inlet port, and to assist the rotating exhaust shaft in forcing exhaust into the exhaust manifold.

5. The valve system of claim 1 wherein the intake indent element has a concave shape.

6. The valve system of claim 1 wherein the intake indent element has a generally rectangular shape having at least one concave side.

7. The valve system of claim 1 wherein the intake indent element has a wedge shape.

8. The valve system of claim 1 wherein the exhaust indent has a concave shape.

9. The valve system of claim 1 wherein the exhaust indent element has a generally rectangular shape having at least one concave side.

10. The valve system of claim 1 wherein the exhaust indent element has a wedge shape.

11. The valve system of claim 4 wherein the intake port of the combustion chamber and the inlet port of the exhaust manifold include at least one oil seal.

12. The valve system of claim 4 wherein the intake port and exhaust port of the combustion chamber include at least one compression seal.

13. The valve system of claim 1 wherein the intake and exhaust shafts are driven by a crankshaft belt driven system.

14. The valve system of claim 1 wherein the means for lubricating the intake and exhaust shafts include lubrication channels formed around the circumference of the shaft for delivering lubrication to the shafts from an oil source.

15. A rotary valve shaft indent system for use in internal combustion engines comprising an intake manifold having an exit port;

an exhaust manifold having an inlet port;

at least one combustion chamber having a piston, an ignition point, an intake port and an exhaust port;

a cylinder head;

a hollow intake shaft having at least one generally rectangular shaped intake indent element disposed thereon;

a hollow exhaust shaft having at least one generally rectangular shaped exhaust indent element disposed thereon;

a plurality of lubrication channels disposed about the circumference of the intake and exhaust shafts;

and fins disposed at least at one end of the intake and exhaust shafts, said fins extending outwardly along the shafts longitudinal axis for the purpose of drawing ambient air into the shaft for cooling the shafts;

wherein the intake and exhaust shafts are securely disposed within a corresponding shaft sleeve and rotatably mounted within the cylinder head between the combustion chamber and the intake and exhaust manifolds by at least one bearing positioned at each end of the shaft sleeve;

whereby upon rotation of the intake shaft, the intake indent element allows for intermittent connection of the intake manifold exit port and the combustion chamber intake port, and the unrestricted and direct flow of an air/fuel mixture into the combustion chamber; upon rotation of the exhaust shaft, the exhaust indent element allows for intermittent connection of the combustion chamber exhaust port and the exhaust manifold inlet port, and the unrestricted and direct flow of exhaust from the combustion chamber; and during combustion, the intake and exhaust shafts rotate so as to seal the combustion chamber from the intake and exhaust manifolds.

16. The rotary valve shaft indent system of claim 1 or 15 wherein upon intermittent connection of the intake manifold and the combustion chamber, an air/fuel mixture engages a surface of the intake indent element and pushes the intake shaft in its direction of rotation causing the intake indent to force the air/fuel mixture into the combustion chamber; and upon intermittent connection of the combustion chamber to the exhaust manifold, exhaust gases engage a surface of the exhaust indent element and push the exhaust shaft in its direction of rotation causing the exhaust indent to force the exhaust gases into the exhaust.

* * * * *

UNITED STATES PATENT AND TRADEMARK OFFICE

CERTIFICATE OF CORRECTION

PATENT NO. : 5,249,553

DATED : October 5, 1993

INVENTOR(S) : James J. Guiod

It is certified that error appears in the above-indentified patent and that said Letters Patent is hereby corrected as shown below:

Column 1, line 60, after "enters" delete "the"; and

Column 3, line 63, after "forces" delete "the".

Signed and Sealed this

Seventeenth Day of May, 1994

*Attest:*

Bruce Lehman

BRUCE LEHMAN

*Attesting Officer*

*Commissioner of Patents and Trademarks*